United States Patent [19]

Nakagiri et al.

[11] 4,078,935

[45] Mar. 14, 1978

[54] SUPPORT MEMBER

[75] Inventors: Takashi Nakagiri; Takayuki Inayama, both of Fujimiya, Japan

[73] Assignee: Fuji Photo Film Co., Ltd., Minami-ashigara, Japan

[21] Appl. No.: 573,232

[22] Filed: Apr. 30, 1975

[30] Foreign Application Priority Data

Apr. 30, 1974 Japan ..... 49-48573
Jun. 13, 1974 Japan ..... 49-67299

[51] Int. Cl.[2] ..... G03C 1/78; G03C 1/96

[52] U.S. Cl. ..... 96/87 A; 96/94 BF; 428/328

[58] Field of Search ..... 96/87 A, 94 BF; 428/328

[56] References Cited

U.S. PATENT DOCUMENTS

| | | | |
|---|---|---|---|
| 1,455,428 | 5/1923 | Coberly | 96/87 A |
| 3,437,484 | 4/1969 | Nadeau | 96/87 A |
| 3,505,066 | 4/1970 | Peisach | 96/94 BF |
| 3,537,855 | 11/1970 | Lubin et al. | 96/94 BF |
| 3,582,339 | 6/1971 | Martens et al. | 96/87 R |
| 3,861,924 | 1/1975 | Mackey et al. | 96/87 A |
| 3,874,878 | 4/1975 | Rasch et al. | 96/87 A |
| 3,874,879 | 4/1975 | Rasch | 96/87 A |

*Primary Examiner*—Jack P. Brammer
*Attorney, Agent, or Firm*—Sughrue, Rothwell, Mion, Zinn and Macpeak

[57] ABSTRACT

A support member comprising a polymer material and a transparent and electrically conductive metal oxide semi-conductor layer on the polymer material. Alternatively, the support member comprises a polymer material, and a transparent and electrically conductive metal oxide semi-conductor layer and a metal fluoride layer on the polymer material. The support member can be used as a support for a photographic member.

21 Claims, No Drawings

SUPPORT MEMBER

BACKGROUND OF THE INVENTION

1. Field of the Invention

The present invention relates to a photographic recording mamber having a semiconductive layer of a metal oxide, which is transparent and electrically conductive, on a polymer material. More particularly, the present invention relates to a member for photographic recording which possesses a remarkable antistatic effect even at low humidities.

2. Description of the Prior Art

Almost all polymer supports have surface resistivities of not less than $10^{13}\Omega$. With those supports which have surface resistivities of not less than $10^{13}\Omega$ at room temperature and under ambient humidity, many problems occur during production or processing of these supports, or in using these supports as photographic film or as fabrics. For example, electrostatic charges are produced by friction and accumulate, causing discomfort due discharge of the accumulated electrostatic charge, adherence of dust, ignition of inflammable materials due to spark discharge, static marks (in a photographic film, the film is exposed by the discharge of the accumulated electric charge, forming spot-like or tree branch-like dots, which are designated static marks.), etc.

In order to prevent a charging of a polymer material which results in the above described various disadvantages, the following methods have hitherto been proposed.

1. A kneading method, in which an antistatic agent is previously incorporated in a polymer material. For example, organic compounds such as imidazoline type metal salts as described in Japanese Patent Publication Nos. 10326/1963 and 10327/1963, quaternary ammonium salts as described in U.S. Pat. Nos. 2,579,375, 2,836,517, Japanese Patent Publication No. 7366/1965, etc., and alkylarylsulfonic acid salts as described in U.S. Pat. No. 2,978,440, or metal compounds such as magnesium oxide as described in U.S. Pat. No. 2,758,984, zinc oxide and titanium oxide as described in U.S. Pat. Nos. 2,887,632, 2,940,941, and 3,062,700, and the like can be used.

2. A coating method, in which an antistatic agent is coated on a polymer material. For example, organic compounds such as alkylsulfonic acid salts as described in U.S. Pat. No. 2,614,984, quaternary ammonium salts as described in U.S. Pat. No. 2,876,127, polyvalent alcohols as described in U.S. Pat. No. 2,995,960, and the like, or metal oxides such as titanium oxide and tin oxide as described in Japanese Patent Publication Nos. 6616/1970 and 24890/1965, and the like can be used.

However, these methods have several disadvantages. For example, in the kneading method, no effect or only a slight effect is obtained unless a large amount of the antistatic agent is used. In the coating method, an organic solvent, which dissolves or swells the support must be used, and thus the planar surface of the support is deteriorated, or pollution based on the removal of the solvent and gases formed results.

Where organic antistatic agents such as alkylsulfonic acid salts, quaternary ammonium salts, and the like are used, the dependency of surface resistivity on humidity is large, and thus these organic antistatic agents have the defect that when the humidity is low, liberation of adsorbed water due to the dryness occurs, resulting in a remarkable decrease in the surface resistivity and in a loss of antistatic capability.

In those cases where metal oxides are used, since organic solvents are used in coating or kneading, problems of pollution due to the removal of the organic solvents occur. Furthermore, since these metal oxide particles form a layer in the form of a dispersion, the electrically conductive property of the layer is poor and the antistatic effect is small unless the amount of the metal oxide particles coated or kneaded is large. Moreover, the use of metal oxides is diadvantageous in that since these metal oxide particles are dispersed, the transparency of the layer is not good.

As described above, both the coating method and the kneading method have various disadvantages.

Recently, as a method free of the above described defects, the so-called vacuum vapor deposition method, in which a metal or a metal oxide is formed in a thin and uniform continuous layer without using any solvent, particularly a metal oxide, is deposited on a support in vacuum, has been proposed. A static charge preventing method comprising forming a deposited layer by vapor deposition, deposition of a metal for static charge prevention of an electron beam recording member is described in British patent specification No. 1,340,403 and U.S. Pat. No. 3,336,596, etc. Since this method is applied to an electron beam recording member, it is sufficient for the metal deposited layer provided to be permeable only to electron beams. In the electron beam recording member, the metal deposited layer need not be permeable to rays having a remarkably small energy as compared with electron beams, particularly visible rays which are important in the field of photographic light-sensitive members. That is, the metal deposited layer can be opaque at the stage of forming latent images. However, in general photographic recording members, particularly, negative films, movie films, X ray films, aero-films, and the like, in which transparency is essential, the deposited layer is not usable for these purposes unless it is transparent even though it possesses static charge prevention effect.

Attempts to use such a deposition method as a static charge prevention method for photographic recording members have now been made as disclosed in German Patent Application (OLS) No. 2,325,729, Belgian Pat. No. 799,893 and Japanese Patent Application (OPI) No. 51930/74. A method comprising forming a layer of a mixture of a metal and inorganic oxides as an intermediate layer between a polymer support and a photographic emulsion layer has been developed. In this case, an intermediate layer comprising 80 to 30% by weight of chromium, silver, nickel, or copper, alone or mixtures thereof, and 20 to 70% by weight of oxides of silicon, magnesium, tantalum, and the like, is provided as a static charge prevention layer. Of these metals, chromium is considered most excellent.

This method removes the above described disadvantages such as great variations in static charge prevention effect due to humidity where organic compounds are used, or opacity or unevenness where inorganic particles are used.

As is well known, however, chromium is quite harmful, and care must be taken in handling chromium. Chromium, copper, silver, nickel, and the like tend to be damaged by acid or alkali. Silver is quite costly and is not desired to be permanently used as an industrial product. Thus, this method is subject to various limitations from the standpoint of the starting materials employed. Furthermore, many difficult problems are encountered in the deposition procedures. That is, since a mixture is used, in this method, in preparing the intermediate layer, the deposition conditions of the mixture are quite complicated as compared with the deposition of a simple substance and even though the "flash method" or the "electron beam method" as described in L. Maissel and R. Glang, *Handbook of Thin Film Technology,* Chapter 1, McGraw-Hill, New York (1970) is used, it is quite difficult to provide a uniform and continuous deposited layer on a wide and long polymer support. As described above, prior art techniques have various problems.

On the other hand, as surface processings for the purpose of increasing the adhesion of the deposited metal to the polymer support, irradiation of electron beams onto the surface of the polymer support as described in, for example, G. M. Sessler, L. E. West, F. W. Ryan and H. Schonhorn, *Journal of Applied Polymer Science,* 17, 3199 to 3209 (1973), glow discharge as described in, for example, L. Holland, *Vaccum Deposition of Thin Films,* p.14, Chapmann & Hall Ltd., (1961), exposure of the polymer support to a plasma discharge atmosphere as described in, for example, Japanese Patent Application (OPI) No. 65271/1973, etc. are known. It is also well known that the surface of glass is, in general, cleaned by ion bombardment in a glow discharge atmosphere and the adhesion of the surface to the vapor deposited metal is increased, as described in, for example, *Hakumaku Kogaku Handbook* (*Handbook of Thin Film Engineering*), p. 1978, published by Ohm Co. (1964), and L. Maissel and R. Glang, *Handbood of Thin Film Technology,* 6–41, McGraw-Hill, New York, (1970), etc. However, it has not been known that the electrical conductivity of a vapor deposited thin film can be increased by applying surface activation processing onto the polymer material.

SUMMARY OF THE INVENTION

The present invention has been developed to remove the above described prior art drawbacks.

The present invention has improved a photographic recording member, particularly the static charge prevention property of the member.

One of the objects of the present invention is to use metals which are non-toxic or have a quite low toxicity.

Another object of this invention is to use metals which are resistant to acid or alkali.

Another object of the present invention is to use a simple substance.

A further object of this invention is to use those metals which are capable of providing a uniform composition.

An even further object is to use metals which are quite inexpensive and effective.

A still further object of this invention feature is to use metal oxide semiconductors, which are produced by oxidation processing after metal deposition.

Another object is to use elements of Groups IVb and Vb of the Periodic Table.

An additional object of the invention is to provide a polymer support having a surface resistivity of not more than about $10^{11}\Omega$.

Another object is to apply surface activation processing to a polymer material to increase its electrical conductivity in a thin film of a metal oxide semiconductor having the same transparency.

A further object is to vapor-deposit a metal fluoride layer on a polymer material layer or semiconductor layer of a metal oxide to increase the transparency and electrical conductivity of the thin film of the metal oxide.

The present invention markedly decreases the surface resistance of a polymer material and provides a product with effective static charge prevention.

The present invention provides a polymer material with various advantageous properties such as chemical resistance, heat resistance, durability, resistance to damage, water resistance, abrasion resistance, good appearance, and the like.

Briefly, the present invention provides a support member comprising a transparent and electrically conductive layer of a metal oxide semi-conductor on a polymer material.

A preferred embodiment of the support member of this invention comprises a polymer support having a transparent and electrically conductive layer of a metal oxide semi-conductor and a layer of a metal fluoride.

DETAILED DESCRIPTION OF THE INVENTION

Heteinafter the present invention will be explained in greater detail.

Suitable polymer supports which can be used herein include commonly used thermoplastic or thermosetting polymer materials. Although polymer supports have generally, as described above, surface resistances of not less than about $10^{13}\Omega$, their surface resistivities can be easily reduced to about $10^{11}\Omega$ or less with the present invention. Thus the present invention is not limited to special polymer materials, and the polymer materials as used herein can contain pigments, brightening agents, antistatic agents, plasticizers, and the like.

These polymer materials include not only polymer compounds per se but also oligomers and precondensates generally well known in the field of polymer chemistry. That is, any synthetic polymer materials such as those used for synthetic resins, synthetic fibers, synthetic moldings, synthetic films, and synthetic rubbers, e.g., addition polymers involving the participation of unsaturated bonds, ring opened polymers, polycondensation polymers, and the like; and natural polymer materials such as natural rubber, cellulose, gelatin, proteins, paper, wood, and the like, or the derivatives thereof can be used.

These synthetic polymer materials include homopolymers or copolymers of olefins, allyl compounds, halogenated olefins, styrenes, heterocyclic vinyl compounds, acetylenes, allenes, butadienes, N-vinyl compounds, vinyl esters, vinyl ethers, vinyl ketones, acrylic acids, acrylonitriles, acrylamides, methacrylic acids, oxiranes, lactams, or the like. Furthermore, the polymer materials include thermosetting or thermoplastic resins such as polyimines, polyesters, polyethers, polycarbonates, polysulfides, polysulfones, polysulfonamides, polypeptides,, polyamides, polyurethanes, polyureas, polymers of acid anhydrides, alkyd resins, unsaturated polyesters, epoxy resins, ketone resins, phenol resins, urea resins, furan resins, xylene resins, toluene resins, aniline resins, diallylphthalate resins, silicone resins, and the like, or the cross-linked resins thereof.

For example, halogen containing synthetic resins such as polyvinyl chloride, polyvinyl bromide, polyvinyl fluoride, polyvinylidene chloride, chlorinated polyethylene, chlorinated polypropylene, brominated polyethylene, chlorinated rubber, a vinyl chloride-ethylene copolymer, a vinyl chloride-propylene copolymer, a vinyl chloride-styrene copolymer, an isobutylene chloride copolymer, a vinyl chloride-vinylidene chloride copolymer, a vinyl chloride-styrene-maleic anhydride terpolymer, a vinyl chloride-styrene-acrylonitrile copolymer, a vinyl chloride-butadiene copolymer, a vinyl chloride-isoprene copolymer, a vinyl chloride-chlorinated propylene copolymer, a vinyl chloride-vinylidene chloride-vinyl acetate terpolymer, a vinyl chloride-acrylate copolymer, a vinyl chloride-maleate copolymer, a vinyl chloride-methacrylate copolymer, a vinyl chloride-acrylonitrile copolymer, an internally plasticized polyvinyl chloride, a vinyl chloride-vinyl acetate copolymer, polyvinylidene chloride, a vinylidene chloride-methacrylate copolymer, a vinylidene chloride-acrylonitrile copolymer, a vinyl chloride-acrylate copolymer, a chloroethyl vinyl ether-acrylate copolymer, polyvinylidene fluoride, polytetrafluoroethylene, polychloroprene, and the like; polyethylene, polypropylene, polybutene, poly-3-methylbutene, poly-1,2-butadiene, an ethylene-propylene copolymer, an ethylene-vinyl ether copolymer. an ethylene-propylene-1,4-hexadiene copolymer, fluorinated polyethylene, an ethylene-vinyl acetate copolymer, a copolybutene-1-propylene copolymer, a butadiene-acrylonitrile copolymer, and blends of these copolymers and the above described halogen containing synthetic resins; acryl resins such as a methyl acrylate-acrylonitrile copolymer, an ethyl acrylate-styrene copolymer, a methyl methacrylate-acrylonitrile copolymer, a methyl methacrylate-styrene copolymer, a butyl methacrylate-styrene copolymer, polymethyl acrylate, polymethyl α-chloroacrylate, polymethoxyethyl acrylate, polyglycidyl acrylate, polybutyl acrylate, an acrylic acid-butyl acrylate copolymer, an acrylate-butadiene-styrene copolymer, a methacrylate-butadiene-styrene copolymer, a methyl methacrylate/ethyl acrylate/2-hydroxyethyl acrylate/methacrylic acid (67/23/7/3 by weight) copolymer, a methyl methacrylate/ethyl acrylate/2-hydroxyethyl acrylate/methacrylic acid (73/17/7/3 by weight) copolymer, a methyl methacrylate/ethyl acrylate/2-hydroxyethyl acrylate/methacrylic acid (70/20/7/3 by weight) copolymer, a methyl methacrylate/butyl acrylate/ 2-hydroxyethyl acrylate/methacrylic acid (70/20/7/3 by weight) copolymer, and the like; polystyrene, poly-α-methylstyrene, a styrene-dimethyl phthalate copolymer, a styrene-maleic anhydride copolymer, a styrene-butadiene copolymer, a styrene-butadiene-acrylonitrile copolymer, poly-2,6-dimethylphenyleneoxide, a styrene-acrylonitrile copolymer, polyvinyl carbazole, poly-p-xylylene, polyacetal, polyvinyl acetate, polyvinyl alcohol, polyvinyl formal, polyvinyl acetal, polyvinyl butyral, polyvinyl phthalate, cellulose, ethylcellulose, butylcellulose, hydroxyethylcellulose, hydroxypropylcellulose, cellulose tetrahydrophthalate, cellulose acetate, cellulose butyrate, carboxymethyl cellulose, cellulose acetate butyrate, nitrocellulose, cellulose phthalate, pulp, nylon 6, nylon 66, nylon 12, methoxymethyl-6-nylon, nylon 6,10, polycapramide, polyethylene sebacate, polybutylene glutarate, polyhexamethylene adipate, polybutylene isophthalate, polyethylene terephthalate, polyethylene adipateterephthalate, polyethylene-2,6-naphthalate, polydiethyleneglycol terephthalate, polyethyleneoxy benzoate, bisphenol A-isophthalate, polyacrylonitrile, the polyimide as described in U.S. Pat. No. 3,794,547, bisphenol A-adipate, glass fiber reinforced unsaturated polyesters, polyhexamethylene-m-benzenesulfonamide, methylenebis-4-phenylene urea, a guanamine-melamine-formaldehyde resin, polytetramethylene hexamethylene carbonate, polyethylenebis-4-phenylenecarbonate, bisphenol A-polycarbonate, polyethylene-tetrasulfide, polyethyleneoxide, polytetrahydrofuran, polybis-chloromethyloxetane, polyoxymethylene, butyl rubber, neoprene rubber, polyisoprene, copolypropylene-isoprene, styrene-butadiene rubber, silicone rubber, polyhexamethylene urea, polydimethylsiloxane, polymethylphenylsiloxane, gelatin, acylated gelatin such as phthalated gelatin, malonated gelatin, and the like, grafted gelatin in which gelatin is grafted with α,β-unsaturated acids or the amides thereof, starches such as starch, hydroxyethyl starch, hydropropyl starch, and the like, shellac, polyglycerol monoacrylate, polyvinyl pyrrolidone, a vinyl pyrrolidone-vinyl acetate copolymer, a cumarone-indene resin, casein, agarose, sodium alginate, dextran, gum arabic, albumin, polysaccharide, polyacrylamide, polytrimethylvinyl benzylammonium chloride, polydiallyl dimethylammonium chloride, and the like can be used.

These resins can be used alone depending on the use thereof, and they can also be used as mixtures with each other or in a laminated form.

These resins can be in the forms of moldings, films, filaments, tubes, and in some cases, particles.

The form, size, composition, and the like of these polymer materials can be varied greatly and these properties are not limited to specific ones.

Various additives can be incorporated in these polymer materials.

These additives can vary depending on the use, and in general, they include an antioxidant, a stabilizer, a plasticizer a filler, a dye, a pigment, an antistatic agent, and the like.

As the antioxidant, 2,6-di-t-butyl-p-cresol, 2,2'-methylene-bis-6-t-butyl-4-methylphenol, zinc dibutyldithiocarbamate, triphenylphosphite, α-cyano-β-phenyl benzylcinnamate, benzotriazinylphenol, and the like can be used.

As the plasticizer, dibutylphthalate, dioctylphthalate, dioctyladipate, butylbenzyl phthalate, epoxidized soybean oil, tricresyl phosphate, trioctyl phosphate, diethyleneglycol adipate, tributylacetyl citrate, and the like can be used.

As the dye and pigment, phthalocyanine, Phthalocyanine Blue, dimesidinoanthraquinone, titanium oxide, glass beads, zinc white, zirconium oxide, quinacridonesulfonamide, and the like can be used.

As the stabilizer, tris-styrenated phenol, phenyl-β-naphthylamine, bishydroxyphenyl cyclohexane, and the like can be used.

The kinds of these additives, the amounts of these additives employed, the most suitable cominations of these additives and polymer materials, and the like can be easily determined by one skilled in the art based on the prior art, for example, *Plastic Kako Gijyutsu Binran* (*Handbook of Plastic Processing Technology*), published by Nikkan Kogyo Shimbun Co., Tokyo (1969), *Muki Yuki Kogyo Zairyo Binran* (*Handbook of Inorganic and Organic Industrial Materials*), published by Toyo Keizai Shinbun Co., Tokyo (1960), etc.

Hereinafter, the present invention will be explained in greater detail by reference to an article comprising a polymer material as a support and a hydrophilic layer, particularly a photographic emulsion layer, provided on the polymer material where the present invention is used in the field of photographic recording members.

As polymer supports as used herein, taking into account transparency, flexibility, and other physical properties which are required for supports for photography, cellulose derivatives such as cellulose acetate, cellulose acetate propionate, styrene based polymers such as polystyrene, a styrene-butadiene copolymer, poly-$\alpha$-methylstyrene, and the like, polyesters such as polyethylene terephthalate, polyhexamethylene terephthalate, polyethylene naphthalate, and the like, polyolefins such as polyethylene, polypropylene, and the like, polycarbonate, paper, etc. can be selected.

These supports can be transparent, can contain those dyes as incorporated in X ray films, or can contain white pigments such as titanium oxide, and furthermore they can be laminate films produced by laminating plastic on paper, or can be laminate films which are subjected to the surface treatment as described in Japanese Patent Publication No. 19068/1972.

The film thickness is not limited and can be varied greatly according to the use of the support within the range of about 10 to 500 $\mu$. The form of the support is not always limited to a film and can exist as a sheet, etc.

The vapor-deposited layer of the present invention comprises metal oxide semi-conductors. For this purpose, elements of Groups IVb and Vb of the Periodic Table can be used, and particularly in view of easy-handling and effect, metals or the oxides thereof of Groups IVb and Vb such as titanium (Ti), zirconium (Zr), vanadium (V), niobium (Nb), and the like are useful. These elements can be used individually or as mixtures thereof.

Of these elements, titanium compounds are most suitable from the standpoint of chemical resistance, specific gravity, cost, ease of handling, and the like.

On this metal oxide semi-conductor layer is, if desired, coated a photographic emulsion layer containing silver halide or silver developing nuclei for black and white photography, color photography, and the like, or a non-silver salt organic light-sensitive layer.

The metal oxide semi-conductor layer can be provided on a polymer support, or a support subjected to surface activation, or a metal fluoride layer, by vaporizing the above described metals, alone or in combination with each other, in a low pressure, e.g., $10^{-4}$ to $10^{-7}$ Torr by indirect resistance heating or electron beam heating, condensing the vapor so produced on the support surface to form a vapor deposited film of the metal thereon, and then oxidizing the vapor deposited film.

For this forced oxidation processing, various oxidation methods such as glow discharge or electrode-less discharge under reduced pressure, e.g., 10 to $10^{-3}$ Torr, or in an atmosphere under reduced pressure, e.g., 10 to $10^{-3}$ Torr and replaced with oxygen, anodic oxidation under atmospheric pressure, oxidation using organic oxidants, etc. can be used. For example, glow discharge is described in U.S. Pat. No. 3,057,792, and electrode-less discharge is described in U.S. Pat. No. 3,462,335.

It has been found that the application of such an oxidation processing enables the cohesive force, strength, and transparency of the vapor-deposited film to be increased.

The transparency of the vapor-deposited film varies depending on the thickness of the vapor-deposited film. However, since the effect of the forced oxidation processing is large, the transparency can be greatly increased by application of the forced oxidation processing. For example, where polyethylene terephthalate of a thickness of 100 $\mu$ is used as a support and a vapor deposited film of titanium is provided on the support in a thickness of 65 A, O.D. (Optical Density) prior to the oxidation is 0.08, but can be reduced to 0.05 by application of glow oxidation. In this case, the surface resistivity prior to the oxidation processing is $10^5\Omega$, and after the oxidation processing, $10^6\Omega$. In this way, although the surface resistivity after the oxidation processing is slightly higher, these values are sufficiently satisfactory from the standpoint of static charge prevention.

Of the above described forced oxidation processings, glow discharge, electrode-less discharge, and the like are most suitable in oxidation efficiency, convenience in processing, and the like. The oxidation period required for reducing the optical density of the vapor deposited film by the same quantity, i.e., rendering transparent, varies greatly depending on the pressure. In electrode glow discharge, the oxidation processing of a pressure ranging from about $1 \times 10^{-2}$ to $6 \times 10^{-2}$ Torr decreases the processing period and is most effective. On the other hand, in electrode-less discharge, a pressure of from about 1 to 5 Torr decreases the oxidation processing period and provides remarkable results.

As the device for producing the vapor deposited support of the present invention, hitherto known indirect resistance heating type or electron beam heating type vacuum vapor-depositing devices as described in, for example, T. Sawaki, *Shinku Jyotyaku* (*Vacuum Vapor Depositing*), published by Nikkan Kogyo Shinbun Co., Tokyo (1962), S. Miyake, *Hakumaku no Kisogijyutsu* (*Fundamental Technology of Thin Film*), published by Asakura Shoten, Tokyo (1969), and L. Maissel and R. Glang, *Handbook of Thin Film Technology,* published by McGraw-Hill, New York (1970), can be used. The vapor deposition temperature can be determined taking into account the kind of the metal to be vapor deposited and the fact that the boiling point of the metal varies depending on the degree of vacuum. For example, since boiling points of titanium, zirconium, and vanadium are, at a pressure of $1 \times 10^{-4}$ Torr, 1570° C, 2,000° C, and 1,630° C, respectively, vapor deposition of these metals can be conveniently effected by setting the vapor deposition temperature at higher temperatures than these boiling points.

Where the vapor deposition is applied onto polymer supports of low heat durability such as polyethylene, polystyrene, and the like, it is desirable to cool the support during the vapor deposition operation.

In general, at temperatures higher than the boiling point, as the vapor deposition temperature is increased, the speed of vapor deposition is increased, and these conditions can be appropriately selected according to production conditions.

Transparency must be taken into account from the standpoint of the static charge prevention of the photographic light-sensitive member. Thus the thickness of the vapor deposited film is about 20 to 300 A and preferably about 30 to 150 A.

A metal oxide semi-conductor layer produced from a deposited film of a thickness of less than about 30 A, is transparent, but its surface resistivity is large, e.g., not less than $10^{11}\Omega$, whereas the surface resistivity of a metal oxide semi-conductor layer produced from a deposited film of a thickness of above 150 A is sufficiently small, e.g., not more than $10^3\Omega$, but its optical density is high, thereby deteriorating the transparency to an extreme degree. Furthermore, since a vapor deposited film with a film thickness on the order as described above can be produced by exposing a support in a metal vapor atmosphere in a quite short period of time, e.g., in general, several seconds, the support is not damaged at all by heat and the like, and moreover, a sufficient static charge prevention effect can be obtained.

The pressure during vapor deposition preferably ranges from about $2 \times 10^{-4}$ to about $1 \times 10^{-6}$ Torr although thus can vary depending on the use of the deposited film.

This is because the vapor deposition can be most effectively carried out considering the mean free path in the above described pressure range, the time required for attaining the pressure, and the like.

The effect of the present invention is obtained by using, as described above, titanium, zirconium, vanadium, niobium, and the like of Groups IV*b* and V*b* of the periodic table as metals for use in vapor deposition. In particular, for the same thickness titanium and zirconium are preferred from the standpoints of transparency, surface resistivity, film strength, adhesion to a support, and the like. It has been found that the dependency of surface resistivity on humidity is hardly observed with the vapor deposited film of the present invention.

A metal oxide is produced by vapor depositing a metal on a polymer support followed by forced oxidation processing. As this forced oxidation processing, as described above, electrode discharge and electrode-less discharge in an oxygen atmosphere can be effectively employed.

Thus, by effecting vapor deposition and forced oxidation processing in a vacuum device which is divided into two chambers, one of which is for vapor deposition, e.g., at $10^{-4}$ to $10^{-6}$ Torr, and the other is for the forced oxidation processing, e.g., at $1 \times 10^{-2}$ to $6 \times 10^{-2}$ Torr or 1 to 5 Torr, the desired support for photographic recording can be continuously and rapidly obtained.

Incidentally, a semi-conductor is, in general, a substance whose electrical resistance at ordinary temperatures is intermediate, e.g., $10^{-2}$ to $10^{10}\Omega$ cm, between that of a conductor ($\sim 10^{-6}\Omega$ cm) and an insulator ($\sim 10^{12}$ to $\sim 10^{10}\Omega$ cm), as described in, for example, C. Kittel, *Introduction to Solid State Physics,* Chapter 13, John Wiley & Sons, New York (1956).

With bulk materials, the temperature coefficient of electronic resistance indicates whether they are metals or semi-conductors. That is, for metals, as the temperature increases, free electrons are scattered by phonons, resulting in an increase in resistance, and thus the temperature coefficient is positive. On the other hand, for semi-conductors, as the temperature increases, an activation energy is provided so as to free bound electrons or ions, resulting in a decrease in resistance, and thus the temperature coefficient of resistance is negative.

It is known, however, that the temperature coefficient of electric resistance of a metal in the form of a thin film varies according to the film thickness.

In general, the temperature coefficient of a very thin metal film is negative, and that of a thick film is positive as is the bulk situation.

It is known that the temperature coefficient of electrical resistance of a thin titanium film depends on the film thickness thereof, that is, it is positive for a film of a thickness of above about 500 A, while it is negative for a film of a thickness of below 500 A, as described in, for example, F. Huber, *Microelectronics and Reliability,* 4, 283 (1965). With chromium, gold, tantalum, and the like, similar phenomena have been studied particularly in detail.

It is improper to determine if the thin film obtained is a semi-conductor or a metal according to whether the temperature coefficient of electrical resistance is positive or negative. On the other hand, a metal oxide is rendered electrically conductive when the stoichiometric ratios of the metal oxide are changed. For example, it is known that titanium becomes an n-type semi-conductor when its stoichiometric ratios are changed, as described in, for example, M. D. Earle, *Phys. Rev.,* 61, 561 (1942). As a result of investigating the deviation in the ratios of a titanium oxide thin film produced by vapor depositing titanium and then applying glow oxidation processing, from the stoichiometric ratios using ESCA (Electron Spectroscopy for Chemical Analysis), the range of $x$ in $TiO_x$ appears to be 1.4 to 1.99.

As metal atoms for use in forming metal oxide semiconductors, those metals as described in, for example, Kobayashi et al, *Handotai* (*Semi-conductor*), page 27, published by Iwanami, Tokyo (1967) and Kawaguchi et al, *Handotai no Kagaku* (*Chemistry of Semi-conductor*), published by Maruzen, Tokyo (1962), can be used. These metals include Ti, Zr, V, and Nb.

The above described references disclose in detail that of these metals oxides, those oxides whose oxygen content deviates from the stoichiometric ratio, act as semiconductors.

Of these metals, elements of Groups IV*b* and V*b*, particularly titanium is most effective in the present invention in that titanium is chemically stable, possesses a marked static charge prevention capability, and is inexpensive and readily available.

Examples of surface activation processing methods for the support of the present invention, which can be used include glow discharge, electrode-less discharge, irradiation with electron beams, flame treatment, corona discharge, and the like. Of these methods, glow discharge and electrode-less discharge, e.g., as described in U.S. Pat. Nos. 3,059,792, 3,462,335, etc. are most suitable from the standpoint of processing efficiency, convenience in processing, and the like. Oxygen, nitrogen, argon, and the like can be used as gases in which discharge is effected. In particular, oxygen is most effective from the standpoint of processing efficiency.

If the polymer support once subjected to surface activation processing is allowed to stand at ordinary temperatures and humidities, e.g., at 23° C and 65% RH, for a long period of time, e.g., more than 24 hours, the effect of the surface activation processing greatly decreases. Reasons for this are completely different from those in the case of processing in the field of conventional photographic members, and are not apparent. It is, however, believed that the surface once activated is deactivated due to moisture or oxygen in the air although the present invention is not intended to be limited by this consideration.

The effect of the surface activation processing varies depending on the thickness of the deposited film provided on the support which is subjected to activation processing. For example, with a titanium oxide film produced by vapor depositing titanium on a 100 $\mu$ thick polyethylene terephthalate film, which is subjected to surface activation processing, in a film thickness of 65 A and then applying the forced oxidation processing, the optical density is 0.05 and the surface resistivity is $3 \times$ $10^4\Omega$. On the other hand, with a titanium oxide film produced by vapor depositing titanium and then forced oxidation onto a 100 $\mu$ thick polyethylene terephthalate film, which is not subjected to surface activation processing, in the same manner as used in the above case, the optical density is 0.05, but the surface resistivity is $1 \times 10^6\Omega$. That is, surface activation processing enables the surface resistivity to be decreased by more than a factor of 10 in a thin film of the same transparency, that is, it has been found that electric conductivity can be greatly increased by application of surface activation processing.

In general, in a deposited film of a film thickness of less than 100 A, the film structure is not continuous and uniform, and an island structure is observed. This phenomenon is considered to be due to the fact that atoms reaching the support move until they are caught by adsorption sites on the support, as described in, for example, Sheizi Miyake, *Hakumaku no Kisogijyutsu* (*Fundamental Technology of Thin Film*), published by Asakura Shoten, Tokyo (1969) and *Hakumaku Kogaku Handbook* (*Handbook of Thin Film Technology*), published by Chem. Co., Tokyo (1964).

Namely, nucleation and growth at the initial step of the formation of the vapor deposited film are greatly dependent on the surface condition of the support to which vaporized atoms or molecules attach, even though the evaporation rates, the pressure, and the temperature of the support are kept constant.

It is believed that since surface activation processing increases the number of adsorption sites to which vaporized atoms can attach, and produces more numerous islands, the distances between the islands are statistically decreased in a thin film of the same thickness of less than 100 A, and as a result, the electric conductivity is increased. It has been found that in producing a thin film of a thickness of less than 100 A by vapor depositing metals of Group IV*b* of the Periodic Table, surface activation of the polymer support can quite effectively increase the electric conductivity.

It has further been found that the electric conductivity can be markedly increased by vapor depositing a metal fluoride on a polymer support and then providing the metal oxide semi-conductor layer on the metal fluoride layer, as compared with the case where a thin film of the same treansparency is provided with the metal oxide semi-conductor layer alone. This finding will be hereinafter described in detail.

Cryolite ($Na_3AlF_6$), magnesium fluoride ($MgF_2$), lithium fluoride (LiF), calcium fluoride ($CaF_2$), chiolite ($Na_5Al_3F_{14}$), and the like can be used as metal fluorides.

On a 100 $\mu$ thick polyethylene terephthalate film as a polymer support, cryolite is vapor deposited in a thickness of 200 A, and then on the thus prepared cryolite layer, a titanium oxide film is formed by vapor-depositing titanium and applying a forced oxidation processing. In this case, the total optical density of the cryolite layer and the titanium oxide layer is 0.05, and the surface resistivity is $2 \times 10^4\Omega$. On the other hand, with a titanium oxide layer alone which is produced by vapor-depositing titanium on a polyethylene terephthalate film, on which the cryolite layer as described above is not provided, in a thickness of 65 A and by applying a forced oxidation processing, the optical density is 0.05 and the surface resistivity is $1 \times 10^6\Omega$. In this case, conditions during the production of the titanium oxide, i.e., depositing conditions and oxidation conditions are the same as in the above case. That is, with a thin film having the same transparency, the surface resistivity can be decreased by a factor of 10 or more, and thus electric conductivity is markedly increased.

This phenomenon is bilieved to be due to the fact that the change of a surface, to which vaporized atoms are to attach, from polyethylene terephthalate to cryolite renders the deposition of the atoms onto the surface uniform, and thus the distances between islands of the metal oxides are statistically decreased as in the case of the above described surface activation processing.

The effect of the present invention can be attained with a metal fluoride layer having a thickness of more than 100 A. Below 100 A the vapor deposited film is not continuous, resulting in a decrease in the effect of improving the conductivity. The thickness can be increased to about 1500 A, but a thickness of from about 100 to about 500 A is suitable from the standpoint of operation and efficiency.

Furthermore, it has been found that transparency of the vapor deposited film can be further increased by providing an anti-reflection film on the above described metal oxide film. This anti-reflection film preferably has a refractive index of about 1.2 to about 1.4. Therefore, materials for the anti-reflection film which can be used are metal fluorides. By vapor depositing on the above described vapor deposited and oxidized film, for example, magnesium fluoride ($MgF_2$), lithium fluoride (LiF), calcium fluoride ($CaF_2$), cryolite ($Na_3AlF_6$), or chiolite ($Na_5Al_3F_{14}$), or by vapor depositing both of them followed by oxidation, optical density can be decreased by 0.02 to 0.03 and the transparency can be increased. Further, if desired, at this vapor depositing, zinc sulfide, silicon monoxide, and the like can be used simultaneously. Of these metal fluorides, those fluorides containing Na, Al, Li, K, and the like, e.g., cryolite, are the most suitable from the standpoint of influencing a photographic emulsion and stability. A support having the thus treated vapor-deposited film is suitable for use in producing members in which high transparency is required, such as photographic members and the like.

Of these compounds, cryolite is excellent in that it does not adversely influence the photographic properties, e.g., sensitivity, fog, contrast, and the like. In this case, it is preferred that the anti-reflection film has a thickness of 200 to 2500 A, particularly 1000 to 1300 A.

In effecting the present invention, the above described pre-treatment, vapor-deposition, forced oxidation, depositing of an anti-reflection film, and the like can be applied in this order, or the forced oxidation can be employed as a last step. For example, where glow discharge is used in the pre-treatment and the forced oxidation processing, the processing can be continuously conducted in one vacuum device.

In such a case, the speed of processing is quite high, and the processing can be conducted efficiently. Where a support having the vapor deposited film of the present invention is used in preparing photographic members, the vapor-deposited film is provided on one side, or if desired, on both sides of the support in the form of a film. On the thus treated support can be provided various layers such as a commonly used gelatin-silver halide photographic emulsion, a back layer comprising a hydrophilic resin binder and used for the purpose of preventing halation, curling, and the like, etc. Further, it goes without saying that it is possible to previously provide the back layer on the back of the polymer support, the above described vapor-deposited film is then provided on the back layer, and furthermore a photographic layer is provided on the opposite surface. A support provided with the vapor-deposited film of the present invention is not subject to any adverse influences of static electricity during the step of providing the above photographic layer and during use thereof regardless of the method of producing the vapor-deposited film. Furthermore, the thus obtained photographic member is advantageous in that it is free from the formation of static marks under low humidities.

Since the compositional proportions of the metal oxide semiconductor layer of the present invention deviate from the stoichiometric ratios, the semi-conductor layer is not opaque and its resistance is not as high as that of inorganic oxides. Since this layer is provided by vapor deposition, a quite thin and continuous layer, in some cases island-like layer, can be obtained, and thus conductivity can be provided without adversely affecting color, transparency, surface form, and the like that the support inherently possesses.

Although the thin film forming method of the present invention is described in detail with reference to vapor-deposition, a sputtering method, an ion plating method, and the like can be utilized if desired.

Photographic emulsion layers which can be used in the present invention, are briefly explained below.

The binders (hydrophilic protective colloids) for the photographic emulsion layer which can be used in the present invention include synthetic or natural hydrophilic polymer compounds such as gelatin, acylated gelatin, e.g., phthalated gelatin, malonated gelatin, and the like, cellulose derivatives, e.g., carboxymethyl cellulose, hydroxyethyl cellulose, and the like, grafted gelatin in which acrylic acid, methacrylic acid, or the amide derivatives thereof, or the like are grafted to gelatin, polyvinyl alcohol, polyhydroxyalkyl acrylates, polyvinyl pyrrolidone, a vinyl pyrrolidone-vinyl acetate copolymer, casein, agarose, albumin, sodium alginate, a polysaccharide, agar, starch, graft agar, polyacrylamide, polyethyleneimine acrylated compounds, or homo- or co-polymers of acrylic acid, methacrylic acid, acrylamide, N-substituted acrylamide, N-substituted methacrylamide, or the like, or the partially hydrolyzed products thereof, etc. These compounds can be used alone or as a combination with each other. These compounds are described in U.S. Pat. Nos. 2,286,215, 2,322,085, 2,327,808, 2,541,474, 2,563,791, 2,768,154, 2,808,331, 2,852,382, 3,062,674, 3,142,586, 3,193,386, 3,220,844, 3,287,289, 3,411,911, German Pat. Nos. 1,003,587, 1,046,492, etc.

So far as these hydrophilic polymer compounds are used as binders, it is not important in the present invention what is added to these binders. In general, to these hydrophilic binders can be added silver halide, or silver sulfide as used in diffusion transfer photography, noble metal colloids, physical developing nuclei, various additives such as light-sensitive materials, e.g., diazo compounds, couplers, emulsion polymerization latex polymers, carbon black, and the like.

Mixtures comprising two or more binder compounds compatible with each other can be used if desired. Of the above described compounds, the most generally used binder is gelatin, and a part or all of the gelatin can be replaced by gelatin derivatives as well as by synthetic polymer materials.

The present invention will be explained in greater detail by reference to the following examples although the present invention is not construed to be limited thereto. Unless otherwise indicated herein, all parts, percents, ratios and the like are by weight.

EXAMPLE 1

On a film support of polyethylene terephthalate (surface resistivity more than $10^{16}\Omega$) having a thickness of 0.1 mm titanium was vapor-deposited under the conditions of a vapor-deposition temperature of 1750° C and a pressure of $2 \times 10^{-5}$ Torr in a thickness of 50 A when measured with a film thickness measuring device utilizing a quartz crystal vibration method.

The film support as prepared above was subjected to forced oxidation using a glow discharge (discharge output 500 W 10 seconds) in an oxygen atmosphere of a pressure of $5 \times 10^{-2}$ Torr to form a thin film of titanium oxide. Al this time, the optical density of the thin film of titanium oxide was 0.02, and its surface resistivity was $1 \times 10^{9}\Omega$, which remained constant even though the relative humidity was changed from 63% to 10% at 23° C. This showed that the film support as prepared above had sufficient static charge prevention capability even at low humidities.

Furthermore, on the titanium oxide thin film was vapor-deposited cryolite ($Na_3AlF_6$) under the conditions of a vapor-deposition temperature of 1450° C and a pressure of $4 \times 10^{-5}$ Torr in a film thickness of 1100 A. As a result, the total optical density of the titanium oxide thin film and the cryolite thin film was 0.01 and transparency could be enhanced.

EXAMPLE 2

On a film support of polyethylene terephthalate having a thickness of 0.18 mm was vapor-deposited titanium under the conditions of a vapor-deposition temperature of 1750° C and a pressure of $2 \times 10^{-5}$ Torr in a thickness of 80 A when measured with a film thickness measuring device utilizing a quartz crystal vibration method.

The film support as prepared above was subjected to forced oxidation using an electrode-less discharge (high frequency discharge output 600 W 10 seconds) in an oxygen atmosphere of a pressure of 2 Torr to form a hard titanium oxide thin film. At this time, the optical density of the titanium oxide thin film was 0.07, and its surface resistivity remained $2 \times 10^{4}\Omega$ even though the relative humidity was changed from 63% to 10%, that is, the static charge prevention effect was sufficient at low humidities.

Furthermore, on the titanium oxide thin film was vapor-deposited magnesium fluoride ($MgF_2$) at 1650° C and at a pressure of $2 \times 10^{-5}$ Torr in a thickness of 1200 A. As a result, the total optical density of the titanium oxide thin film and the magnesium fluoride thin film was 0.05 and the transparency could be improved.

In place of magnesium fluoride, cryolite was vapor-deposited in the same manner as in Example 1. In this way, the total optical density of the titanium oxide thin film and the cryolite thin film was 0.05 and the transparency could be improved.

Moreover, it was found that with a support produced by vapor-depositing cryolite on the titanium oxide film, the static charge prevention effect was not deteriorated.

EXAMPLE 3

On a film support of cellulose triacetate (surface resistivity more than $10^{16}\Omega$) having a thickness of 0.1 mm titanium was vapor-deposited, while cooling the film support at 10° C, under the conditions of a vapor-deposition temperature of 1700° C and a pressure of $8 \times 10^{-5}$ Torr in a thickness of 65 A when measured with a film thickness measuring device utilizing a quartz crystal vibration method.

The thus obtained film support was subjected to forced oxidation by glow discharge (discharge output 500 W 10 seconds) in an oxygen atmosphere of a pressure of $1 \times 10^{-2}$ Torr to form a thin film of titanium oxide. At this time, the optical density of the titanium oxide thin film was 0.05 and its surface resistivity was remained $1 \times 10^{6}\Omega$ even though the relative humidity was changed from 63% to 10% as in Example 1, that is, the static charge preventing capability at low humidities was sufficient.

Further, on the titanium oxide thin film was vapor-deposited cryolite at 1450° C and at a pressure of $2 \times 10^{-5}$ Torr in a thickness of 1200 A. As a result, the total optical density of the titanium oxide thin film and the cryolite thin film was 0.04, that is, the transparency was improved, and the static charge prevention effect was sufficient.

EXAMPLE 4

On the polyethylene side of a polyethylene laminated paper having a thickness of 0.24 mm zirconium was vapor-deposited, while cooling the paper at 10° C, under the conditions of a vapor-deposition temperature of 2000° C and a pressure of $5 \times 10^{-6}$ Torr in a thickness of 80 A. The film support so prepared was subjected to forced oxidation using a glow discharge (discharge output 500 W 10 seconds) in an oxygen atmosphere of a pressure of $3 \times 10^{-3}$ Torr to form a thin film of zirconium oxide.

Although the relative humidity was changed from 63% to 10% as in Examples 1 and 2, the surface resistivity did not change and was remained at $5 \times 10^{5}\Omega$. This surface resistivity was sufficient to exhibit a sufficient static charge prevention effect at low humidities, and no static problems occurred.

Incidentally, the surface resistivity of the polyethylene laminated paper was more than $10^{16}\Omega$ when the relative humidity was 63%.

EXAMPLE 5

On the vapor-deposited surfaces of the supports produced in Examples 1 and 3, hydrophilic layers (a high sensitive indirect X-ray emulsion containing 9% of gelatin and 9% of silver iodobromide, or a high sensitive negative photographic emulsion containing 7% of gelatin and 7% of silver iodobromide) were coated and developed by conventional methods to measure their photographic capabilities. As a result, it was found that the vapor-deposited film of the present invention did not have any adverse influence upon sensitivity, fog, gradation, and the like.

On the other hand, the emulsion was coated on the opposite side of the film support to measure the static charge preventing effect. With the supports produced in Examples 1 and 3, and a polyester film which did not contain a titanium oxide thin film, as a comparison example, the surface resistivity and percentage of static marks formed were measured and the results obtained are shown in Table 1. The percentage of static marks formed was measured using a method comprising placing an unexposed film on a rubber plate in such a manner that the back layer (the titanium oxide film side, or in the comparison example, the polyester film side) contacted the plate, pressing a rubber roll from above, and peeling the rubber roll off the film.

Table 1

| Properties | Relative Humidity (%) | Sample | | |
|---|---|---|---|---|
| | | Example 1 | Example 2 | Comparison Example |
| Surface Resistivity | 63 | $10^{9}\Omega$ | $10^{6}\Omega$ | More than $10^{16}\Omega$ |
| | 10 | $10^{9}\Omega$ | $10^{6}\Omega$ | More than $10^{16}\Omega$ |
| Percentage of Static Marks Formed | 63 | Not formed at all | Not formed at all | Greatly formed |
| | 10 | " | " | " |

As can be seen from the results in Table 1, in the Comparison Example, the surface resistivity was high, i.e., more than $10^{16}\Omega$ and static marks were greatly produced. On the contrary, in the films of Examples 1 and 3, the surface resistivity was quite small, and no dependency of surface resistivity on the humidity was observed. Static marks were not produced at all, and a satisfactory static charge prevention effect was obtained.

Adhesion of the titanium oxide thin film to the support was excellent in the developer, and fixing solution, and through water-washing. That is, the titanium oxide thin film firmly adhered to the extent that it was not peeled off by scratching in these solutions.

The adhesion was good in the drying stage after each processing. Thus it can be seen that the support of the present invention is excellent as a support for photography.

EXAMPLE 6

A polyethylene terephthalate film support having a thickness of 0.1 mm was subjected to surface activation processing using a glow discharge (discharge output 500 W, 5 seconds) in an oxygen atmosphere of a pressure of $2 \times 10^{-2}$ Torr, and on the thus prepared film support titanium was vapor-deposited under the conditions of a vapor-deposition temperature of 1750° C, a pressure of $2 \times 10^{-5}$ Torr, and a thickness of 50 A in the same vacuum device. The thus vapor-deposited titanium was subjected to forced oxidation using a glow discharge in an oxygen atmosphere under the conditions of a pressure of $5 \times 10^{-2}$ Torr, a discharge output of 500 W, and a processing period of 10 seconds in the same vacuum device to form a titanium oxide thin film. The optical density of the titanium oxide thin film so produced was 0.02, and its surface resistivity was $2 \times 10^{7}\Omega$. This value was smaller by a factor of 100 as compared with Example 1, and it can be seen that the electric conductivity was greatly improved.

Even though the relative humidity was changed from 63% to 10% at a temperature of 23° C, the surface resistivity was constant, i.e., $2 \times 10^{7}\Omega$. Further, on the titanium oxide thin film was vapor-deposited cryolite in the same manner as in Example 1, and the total optical density of the titanium oxide thin film and the cryolite thin film was 0.01.

On the vapor-deposited side of the support as obtained above, a hydrophilic layer comprising a high sensitive indirect X-ray emulsion containing 9% of gelatin and 9% of silver iodobromide, or a high sensitive negative photographic emulsion containing 7% of gelatin and 7% of silver iodobromide) was provided and subjected to developing processing by conventional methods to measure its photographic capability. As a result, it was found that this vapor-deposited film did not have any adverse influence upon sensitivity, fog, gradation, and the like. On the other hand, on the opposite side of the support was coated the above emulsion to measure the static charge prevention capability and formation of static marks. The formation of static marks was measured by a method which comprised placing an unexposed film on a rubber plate in such a manner that the back layer was in contact with the plate, pressing the film from above with a rubber roll, and peeling the rubber roll off the film. As a result, it was found that the film of the present invention had a very small surface resistivity and was substantially free from any dependency of the surface resistivity on humidity, and no static marks were produced at all, and that a satisfactory static charge prevention effect was obtained. The adhesion of the vapor-deposited thin film to the support was excellent in the developer, fixing solution, and through water-washing. That is, the vapor-deposited film firmly adhered to the extent that it was not peeled off by scratching.

The adhesion was good at the drying stage after each processing. Thus it can be seen that the support of the present invention is excellent as a support for photography.

EXAMPLE 7

A 0.1 mm thick cellulose triacetate film support was subjected to surface activation processing using a glow discharge (discharge output 500 W, processing period 7 seconds) in an oxygen atmosphere of a pressure of $4 \times 10^{-2}$ Torr. Subsequently, titanium was vapor-deposited under the conditions of a vapor-deposition temperature of 1700° C, a pressure of $8 \times 10^{-2}$ Torr, and a film thickness of 65 A in the same vacuum device. The titanium so provided was subjected to forced oxidation using a glow discharge in an oxygen atmosphere under the conditions of a pressure of $1 \times 10^{-2}$ Torr, a discharge output of 500 W, and processing period of 10 seconds to form a titanium oxide thin film. At this time, the optical density of the titanium oxide thin film was 0.05, and its surface resistivity was $4 \times 10^4\Omega$, that is, the surface resistivity was decreased by more than a factor of 10 as compared with the surface resistivity in Example 3, and the electric conductivity was greatly improved.

Furthermore, when cryolite was vapor-deposited on the titanium oxide thin film in the same manner as in Example 3, the optical density was 0.04.

EXAMPLE 8

On a 0.1 mm polyethylene terephthalate film support was vapor-deposited cryolite under the conditions of a vapor-deposition temperature of 1450° C and a pressure of $4 \times 10^{-5}$ Torr in a film thickness of 200 A. Further, titanium was vapor-deposited under the conditions of a vapor-deposition temperature of 1750° C and a pressure of $2 \times 10^{-5}$ Torr in a film thickness of 50 A. Subsequently, the titanium so provided was subjected to a forced oxidation using a glow discharge in an oxygen atmosphere under the conditions of a pressure of $5 \times 10^{-2}$ Torr, a discharge output of 500 W, and a processing period of 10 seconds in the same vacuum device to form a titanium oxide thin film. At this time, the total optical density of the titanium oxide thin film and the cryolite thin film was 0.02 and its surface resistivity was $1.5 \times 10^7\Omega$, that is, a conductive layer having a transparency of the same order as in Example 6 was obtained. Moreover, when cryolite was vapor-deposited on the titanium oxide thin film in the same manner as in Example 1, the total optical density of these three layers, cryolite, titanium oxide, and cryolite thin layers, was 0.01.

EXAMPLE 9

The following samples were prepared using a polyethylene terephthalate support having a thickness of 0.18 mm.

Sample A: No processing was applied to the support surface.

Sample B: Surface treatment by glow discharge (a pressure of $5 \times 10^{-2}$ Torr, a discharge output of 500 W, and a processing period of 8 seconds) in an oxygen atmosphere was applied.

Sample C: Cryolite was vapor-deposited on the support surface in a thickness of 200 A under the conditions of a vapor-deposition temperature of 1450° C and a pressure of $4 \times 10^{-5}$ Torr.

On these samples titanium was vapor-deposited under the conditions of a vapor-deposition temperature of 1750° C, a pressure of $2 \times 10^{-5}$ Torr, and a film thickness of 80 A, and was subjected to a forced oxidation using a glow discharge (discharge output 500 W, processing period 15 seconds) in an oxygen atmosphere at a pressure of $2 \times 10^{-2}$ Torr to form a titanium oxide thin film. With these Samples A, B, and C, the transparency and electric conductivity were compared. As a result, the optical density was 0.07 for each of Samples A, B, and C, but the surface resistivity was $3 \times 10^4\Omega$ for Sample A, $2 \times 10^3\Omega$ for Sample B, and $1 \times 10^3\Omega$ for Sample C. In Samples B and C, the surface resistivity was smaller by more than a factor of 10 as compared with Sample A.

That is, with samples which are treated as in Samples B and C, the electric conductivity can be increased by a factor of 10 times at the same transparency as compared with those which are not treated as in Sample A.

EXAMPLE 10

On a film support of polyethylene terephthalate having a thickness of 0.18 mm was vapor-deposited magnesium fluoride ($MgF_2$) in a thickness of 200 A under the conditions of a vapor-deposition temperature of 1650° C and a pressure of $2 \times 10^{-5}$ Torr. Subsequently, titanium was vapor-deposited under the conditions of a vapor-deposition temperature of 1750° C, a pressure of $2 \times 10^{-5}$ Torr, and a thickness of 80 A, and was then subjected to forced oxidation using an electrode-less discharge in an oxygen atmosphere of a pressure of 2 Torr to form a titanium oxide thin film. At this time, the total optical density of the magnesium fluoride layer and the titanium oxide thin film was 0.07, which was the same as in Example 3, but its surface resistivity was $1 \times 10^3$ and could be reduced by a factor of 10 as compared with Example 2. The surface resistivity was constant even though the relative humidity changed from 63% to 10% at 23° C.

Furthermore, on the titanium oxide thin film was vapor-deposited magnesium fluoride under the conditions of a vapor-deposition temperature of 1650° C, a degree of vacuum of $2 \times 10^{-5}$ Torr, and a thickness of 1200 A. The total optical density of the magnesium fluoride, titanium oxide, and magnesium fluoride thin layers was 0.05, that is, the transparency could be improved.

EXAMPLE 11

The following two samples were prepared using film supports of a polycarbonate having a thickness of 0.1 mm.

Sample A: No treatment was applied onto the support surface.

Sample B: Surface treatment using a glow discharge in an oxygen atmosphere under the conditions of a degree of vacuum of $5 \times 10^{-2}$ Torr, a discharge output of 500 W, and a processing period of 5 seconds, was applied onto the support surface.

On these samples zirconium was vapor-deposited, while cooling the supports at 10° C, under the conditions of a vapor-deposition temperature of 2,000° C, a degree of vacuum of $5 \times 10^{-6}$ Torr, and a film thickness of 80 A. The thus prepared samples were then subjected to a forced oxidation using a glow discharge in an oxygen atmosphere of a degree of vacuum of $3 \times 10^{-3}$ Torr under the conditions of a discharge output of 500 W and a processing period of 15 seconds to form a zirconium oxide thin film. The transparency and electric conductivity of Samples A and B were compared. In each of Samples A and B, the optical density was 0.07, and the surface resistivity was $5 \times 10^5 \Omega$ for Sample A and $6 \times 10^4 \Omega$ for Sample B. The surface resistivity of Sample B was lower by about a factor of 10 as compared with that of Sample A, and thus the electric conductivity was improved.

While the invention has been described in detail and with reference to specific embodiments thereof, it will be apparent to one skilled in the art that various changes and modifications can be made therein without departing from the spirit and scope thereof.

What is claimed is:

1. A photographic recording member comprising (a) a support member which comprises a polymer material having thereon a binderless, transparent and electrically conductive layer consisting essentially of a metal oxide semiconductor on said polymer material, said metal oxide semiconductor being selected from the oxides of metals of Groups IVb and Vb of the Periodic Table wherein the oxygen content thereof deviates from the stoichiometric ratio sufficiently that the electrical resistance of said semiconductor is between $10^{-2}$ to $10^{10} \Omega$ cm and (b) a photographic emulsion layer containing a hydrophilic polymer binder on one side of said support member.

2. The photographic recording member according to claim 1, wherein the polymer material is a surface activated polymer material.

3. The photographic recording member according to claim 2, wherein the surface activated polymer material is a polymer material surface activated by glow discharge or electrode-less discharge.

4. The photographic recording member according to claim 1, wherein the metal is titanium or zirconium.

5. The photographic recording member according to claim 1, wherein the thickness of the metal oxide semiconductor layer is from about 30 A to 150 A.

6. The photographic recording member according to claim 1, wherein said metal oxide is $TiO_x$ and $x$ is about 1.4 to 1.99.

7. The photographic recording material according to claim 1 wherein said support member also has thereon a metal fluoride layer having a refractive index of about 1.2 to 1.4.

8. The photographic recording member according to claim 7, wherein the metal oxide semi-conductor layer is on the polymer material and the metal fluoride layer is on the metal oxide semi-conductor layer.

9. The photographic recording member according to claim 7, wherein the metal fluoride layer is on the polymer material and the metal oxide semi-conductor layer is on the metal fluoride layer.

10. The photographic recording member according to claim 7, wherein the metal fluoride layer is on the polymer material, the metal oxide semi-conductor layer is on the metal fluoride layer, and further including a metal fluoride layer on the metal oxide semi-conductor layer.

11. The photographic recording member according to claim 7, wherein the polymer material is a surface activated polymer material.

12. The photographic recording member according to claim 11, wherein the surface activated polymer material is a polymer material activated by glow discharge or electrode-less discharge.

13. The photographic recording member according to claim 7, wherein the metal is titanium or zirconium.

14. The photographic recording member according to claim 7, wherein the metal fluoride is a fluoride of sodium, aluminum, lithium, magnesium, calcium or potassium.

15. The photographic recording member according to claim 7, wherein the thickness of the metal oxide semi-conductor layer is from about 30 A to 150 A.

16. The photographic recording member according to claim 9, wherein the thickness of the metal fluoride layer directly on the polymer material is from about 100 to 500 A.

17. The photographic recording member according to claim 10, wherein the thickness of the metal fluoride layer directly on the polymer material is from about 100 to 500 A.

18. The photographic recording member according to claim 8, wherein the thickness of the metal fluoride layer on the metal oxide layer is from about 1,000 to 1,300 A.

19. The photographic recording member according to claim 10, wherein the thickness of the metal fluoride layer on the metal oxide layer is from about 1,000 to 1,300 A.

20. The photographic recording member according to claim 7 wherein the metal fluoride is a member selected from the group consisting of magnesium fluoride, lithium fluoride, calcium fluoride, cryolite and chiolite.

21. The photographic recording member according to claim 20, wherein the metal fluoride is cryolite.

* * * * *